US006004889A

United States Patent [19]

Ichikawa

[11] Patent Number: 6,004,889

[45] Date of Patent: Dec. 21, 1999

[54] COMPOSITION FOR ANTISTATIC FINISH

[75] Inventor: Yoshio Ichikawa, Kanagawa, Japan

[73] Assignee: Kabushiki Kaisya Nippankenkyusyo, Yokohama, Japan

[21] Appl. No.: 09/067,722

[22] Filed: Apr. 28, 1998

[51] Int. Cl.[6] ..... B05D 3/02; D06M 11/45; D06M 11/83

[52] U.S. Cl. ..... 442/110; 252/8.63; 252/8.81; 260/DIG. 16; 260/DIG. 21; 427/393.1; 427/393.4; 516/93; 524/911

[58] Field of Search ..... 516/93; 260/DIG. 16, 260/DIG. 21; 510/515, 517; 252/8.63, 8.81; 427/393.1, 393.4; 524/911; 442/110, 281, 228, 164, 167

[56] References Cited

U.S. PATENT DOCUMENTS

| | | | |
|---|---|---|---|
| 3,529,990 | 9/1970 | Becker et al. | 252/8.63 X |
| 3,585,207 | 6/1971 | Repsher | 516/93 X |
| 4,393,159 | 7/1983 | Lybrand | 260/DIG. 16 |
| 4,816,182 | 3/1989 | Novich et al. | 516/93 X |
| 5,118,578 | 6/1992 | Berger et al. | 427/393.1 X |

FOREIGN PATENT DOCUMENTS

| | | | |
|---|---|---|---|
| 2298535 | 12/1990 | Japan | 524/911 |
| 1097336 | 1/1968 | United Kingdom | 427/393.4 |

*Primary Examiner*—Richard D. Lovering
*Attorney, Agent, or Firm*—Burgess, Ryan & Wayne

[57] ABSTRACT

Disclosed is a compositions for antistatic finish, which is useful for antistatic stockings, comprising (a) 100 parts by weight of colloidal or ultrafine granular alumina on a solid basis, (b) 3 parts to 50 parts by weight of a binder on a solid basis, (c) 0.02 part to 2 parts by weight of at least one selected from the group consisting of silver salts, copper salts and colloidal silver on a metallic atom basis, and (d) 848 parts to 896.08 parts by weight of water (including water occasionally contained in the components of (a) to (c)).

7 Claims, No Drawings

COMPOSITION FOR ANTISTATIC FINISH

BACKGROUND OF THE INVENTION

The present invention relates to compositions for antistatic finish and antistatic stockings using the compositions. More particularly, the present invention relates to compositions for imparting an antistatic finish, for forming transparent films excellent in antistatic, deodorizing, antimicrobial, drying, heat radiating and self cleaning (degrease-decomposing) properties on surfaces of clothes such as woven fabrics, knitted fabrics and nonwoven fabrics, leathers or tatami mats, and antistatic stockings using the compositions.

Previously, no optimum methods have been found for improving the antistatic and drying (hydrophilic) properties of clothes, particularly synthetic fiber clothes, while providing deodorizing and antimicrobial properties at the same time. Methods for imparting the antistatic property by use of surfactants, and methods for providing the antimicrobial and deodorizing properties by mixing drugs or inorganic or organic antimicrobial agents with resins have been proposed. However, all of these methods have problems with regard to their performances.

SUMMARY OF THE INVENTION

It is therefore an object of the present invention to provide compositions for antistatic finish, for forming transparent films excellent in antistatic, deodorizing, antimicrobial, drying, heat radiating and self cleaning (degrease-decomposing) properties on surfaces of clothes such as woven fabrics, knitted fabrics and nonwoven fabrics, leathers or tatami mats.

Another object of the present invention is to provide antistatic stockings using the compositions described above.

According to the present invention, there is provided a compositions for antistatic finish comprising, (a) 100 parts by weight of colloidal or ultrafine granular alumina on a solid basis, (b) 3 parts to 50 parts by weight of a binder on a solid basis, (c) 0.02 part to 2 parts by weight of at least one member selected from the group consisting of silver salts, copper salts and colloidal silver on a metallic atom basis, and (d) 848 parts to 896.08 parts by weight of water (including water occasionally contained in the components of (a) to (c)).

Here, the average particle size or the average thickness of colloidal or ultrafine granular alumina of (a) is preferably 5 mμ to 50 mμ.

Further, the binder of (b) is preferably a synthetic resin emulsion and/or a water-soluble synthetic resin.

Furthermore, according to the present invention, there are provided antistatic stockings to which the above-mentioned composition for antistatic finish have been applied.

DESCRIPTION OF THE PREFERRED EMBODIMENTS

Of the alumina components of (a) constituting the composition for the antistatic finish of the present invention, colloidal alumina is an alumina sol having a pH of 2.5 to 6 in which water is used as a dispersion medium, 5% to 25% by weight of alumina is contained, and an acid such as nitric acid, hydrochloric acid or acetic acid is used as a stabilizer.

Further, ultrafine granular alumina is alumina obtained by high-temperature hydrolysis of a purified aluminum salt. Examples thereof include alumina having a specific surface area (BET method) of 100±15 $m^2/g$ in a 4 wt % aqueous dispersion having a pH of 4.5 to 5.5. Specific examples of ultrafine granular alumina include Aluminum Oxide C manufactured by Degusa Co.

In the present invention, such alumina has a high positive charge, so that the antistatic property of the coated film is improved. As a result, the soil resistance is also improved. Further, alumina of (a) allows the components of (c) to be absorbed, and also improves the adherence and the heat radiating property of the coated film. Furthermore, it can improve the hydrophilic property and the drying property.

Colloidal or ultrafine granular alumina of (a) is preferably granular or feathery alumina having an average particle size or average thickness of 5 mμ to 50 mμ.

Then, the binder of (b) constituting the composition for antistatic finish of the present invention acts as a binder for the coated film, improves the wear resistance of the coated film and functions for improving the water resisting property and the washing resistance. The binders include synthetic resin emulsions and water-soluble synthetic resins.

Examples of the above-mentioned synthetic resins include but are not limited to emulsion type and water-soluble type resins such as acrylic resins, alkyd resins, melamine resins, phenol resins, epoxy resins, polybutadiene, styrene-butadiene copolymers, acrylic-styrene copolymers, acrylic modified urethane resins and silicone resins.

These resins are usually used as emulsions or aqueous solutions as described above.

For example, when the above-mentioned resins are well mixed with water and dried, water-insoluble transparent or translucent films are formed. In the present invention, they are used for adhering the components of (a) and (c).

Examples of the emulsions of the above-mentioned resins include vinyl acetate emulsions, acrylic resin emulsions, acrylic-styrene copolymer emulsions, styrene-butadiene copolymer emulsions, acrylic modified urethane resin emulsions and silicone resin emulsions. Further, examples of the water-soluble resins include water-soluble melamine resins, water-soluble phenol resins, water-soluble polybutadiene and water-soluble acrylic resins.

The above-mentioned resins may be used either alone or as a combination of two or more of them.

The amount of the binder used is 3 parts to 50 parts by weight, and preferably 10 parts to 30 parts by weight, on a solid basis, based on 100 parts by weight of alumina on a solid basis. Less than 3 parts by weight results in low adhesion and deterioration of the washing resistance and the water resisting property, whereas exceeding 50 parts by weight unfavorably results in deterioration of touch or deterioration of functions such as the antistatic, drying, antimicrobial and deodorizing properties.

Then, the component of (c) constituting the composition for antistatic finish of the present invention is effective for adding the functions of the antimicrobial, deodorizing and self cleaning (degrease-decomposing) properties by allowing them to be carried on the coated film formed by the components of (a) and (b).

Of the components of (c), the silver and copper salts are ionized in extremely slight amounts with a slight amount of moisture in the air, or in water. The ionized amount is usually about 0.002 to about 0.02 μg/ml.

Of the components of (c), the silver and copper salts include silver nitrate, silver sulfate, silver chloride, copper nitrate, copper sulfate, copper bromide, copper acetate, and other silver salts and copper salts. Colloidal silver includes fine granular silver having an average particle size of 0.05 μm or less.

The amount of the component of (c) contained in the composition of the present invention is 0.02 part to 2 parts by weight, and preferably 0.05 part to 0.5 part by weight, on a metallic atom basis, namely on a silver or copper atom basis, based on 100 parts by weight of alumina of (a) on a solid basis. Too small an amount unfavorably results in a decreased ionized amount to cause failure to exhibit the deodorizing, antimicrobial and self cleaning properties, whereas too large an amount unfavorably results in discoloration or elution.

Then, the water of (d) constituting the composition for antistatic finish of the present invention is used as an agent for adjusting the solid concentration and viscosity of the composition of the present invention, and further as a dispersing agent.

As the water of (d), tap water, distilled water or ion-exchanged water can be used. When water is contained in the components of (a) to (c), the water of (d) also include this water.

The amount of the water of (d) contained in the composition of the present invention is 848 parts to 896.08 parts by weight, and preferably 850 parts to 890 parts by weight, based on 100 parts by weight of alumina of (a) on a solid basis. If the amount of the water of (d) is less than 848 parts by weight, the viscosity of the composition unfavorably increases too high, or the dispersibility is unfavorably lowered. 896.08 parts by weight is an amount for bringing the total amount to 1,000 parts by weight.

The composition of the present invention can be contain various additives such as surfactants, dyes, pigments and adhesive auxiliaries if necessary, in addition to the above-mentioned components of (a) to (d).

The composition for antistatic finish of the present invention comprises the above-mentioned components of (a) to (d) and optionally an additive or additives, and the pH thereof is usually 4 or more.

Further, the solid concentration of the composition of the present invention is 1% to 17.8% by weight, and preferably 2% to 12% by weight. Less than 1% by weight results in a decreased deposit to cause failure to exhibit the desired performances, whereas exceeding 17.8% by weight unfavorably results in increased viscosity to deteriorate the workability and an increased deposit to deteriorate the touch.

Methods for preparing the composition of the present invention include but are not limited to the following methods.

(1) When the component of (a) is colloidal, the component of (c) is dissolved in the component of (d), and the component of (a) is added thereto, followed by stirring. Then, the component of (b) is added to the resulting mixture, followed by sufficient stirring to prepare the composition.

(2) When the component of (a) is fine granular, the components of (d) and (c) are added to the component of (a) and the mixture is lightly stirred. Then, the component of (b) is added thereto and the resulting mixture is stirred with a very high speed stirrer to form an uniform dispersion of the composition.

Base materials to which the composition of the present invention is applied are organic base materials such as clothes (such as woven fabrics, knitted fabrics and nonwoven fabrics), paper, natural and synthetic leathers, tatami mats and plastics. In particular, specific examples of the base materials include stockings, curtains, carpets, underwear, other clothing, insoles, quilt covers, sheets, furniture (including inner surface), tatami mats and the upholstery of cars (ceilings and sides).

The base material can be coated with the composition by processing means such as spraying, dipping and roll coating. One processing can deposit 0.1 g to 10 g per $m^2$ of the composition in terms of dry weight, and the operation can be repeated again.

The compositions of the present invention form coated films for a short period of time under temperatures ranging from room temperature to 150° C. when applied to the base materials, and form coated films in which the components of (a) to (c) are compounded, with evaporation of water.

The coated film is particularly excellent in adhesion to almost all base materials such as surfaces of clothes (such as woven fabrics, knitted fabrics and nonwoven fabrics), leathers and tatami mats. Excellent in antistatic, deodorizing, antimicrobial, drying, heat radiating and self cleaning (degrease-decomposing) properties can be imparted by the composition of the present invention due to the synergistic effect of alumina of (a), the binder of (b) and the silver salt, the copper salt or colloidal silver of (c).

In particular, when the composition of the present invention is applied to stockings, the feeling, the touch and the color tone thereof are scarcely changed, compared with normal stockings, and the following performances are exhibited.

(1) Antistatic property

Harmful effects such as the clinging of dresses to the stockings and adhesion of dust thereto are eliminated. This is because the surface of the fibers constituting the stockings are positively charged.

(2) Improved drying property

The surface area of fibers is extremely increased, so that the drying property is remarkably improved. Further, the stuffiness and cold disappear to provide a silky touch.

(3) Cool in summer and warm in winter

The drying property is good, and the heat radiating property is excellent (the body heat is received by very fine granular alumina and returned to the skin, and repetition thereof prevents diffusion of the body heat). Accordingly, the stockings feels warm in winter, and cool in summer.

(4) Excellent antimicrobial property

Strong antimicrobial activity to bacteria and fungi (such as Trichophyton) is exhibited by the catalytic function of silver and/or copper adsorbed by alumina.

(5) Deodorizing property

All bad odors are adsorbed and decomposed by the large surface area and the catalytic function of silver and/or copper. The effect thereof does not reach the saturated state, and is maintained until the stockings are worn out.

(6) Harmlessness and persistence

The components of (a) to (c) constituting the composition of the present invention are all harmless substances, and do not produce side effects such as rough skin. Further, the test after washing of continuous 10 cycles shows about 65% of the initial performance. The stockings are therefore sufficient in practical effect.

It goes without saying that the effects of (1) to (6) described above can be similarly achieved not only in the stockings, but also in the above-mentioned other base materials.

The present invention will be described in more detail with reference to the following examples, which are given to illustrate the present invention and are not intended to be limitations on the scope of the invention. "Parts" and "%" given in the examples are by weight unless otherwise specified.

EXAMPLES 1 TO 5 AND COMPARATIVE EXAMPLE 1

Preparation of Compositions for Coating:

The following respective components were mixed for 10 minutes by use of a stirrer, and then dispersed with a very high speed stirrer for 15 minutes to prepare compositions A to E (Examples) and composition F (Comparative Example) having compounding ratios shown in Table 1.

(a)-1: Colloidal alumina (average particle size: about 15 mμ, $Al_2O_3$: about 20%, pH: 2–4)

In Table 1, "500 parts" in (a)-1 means 100 parts of alumina (on a solid basis) and 400 parts of water.

(a)-2: Very fine granular alumina (average particle size: about 20 mμ, 4% aqueous dispersion, pH: 4.5–5)

(b)-1: Aqueous acrylic resin (resin content: 40%, pH: 4–6)

(b)-2: Acrylic resin emulsion (resin content: 60%, pH: 3–4.5)

(b)-3: Vinyl acetate-ethylene copolymer resin emulsion (resin content: 58%, pH: 4.5–5.5)

(c)-1: Silver nitrate (c)-2: Copper nitrate (d)-1: Ion-exchanged water (e)-1: Nonionic surfactant

TABLE 1

| | Example | | | | | Comparative Example |
|---|---|---|---|---|---|---|
| Name of Composition | 1 A | 2 B | 3 C | 4 D | 5 E | 1 F |
| Compounding Formulation (parts) | | | | | | |
| (a)-1 | 500 | — | 500 | 500 | — | 500 |
| (a)-2 | — | 100 | — | — | 100 | — |
| (b)-1 | 30 | — | 10 | — | 110 | — |
| (b)-2 | — | 21 | — | — | — | — |
| (b)-3 | — | — | — | 36 | — | 150 |
| (c)-1 | 0.2 | — | 0.1 | 0.1 | 0.2 | 0.1 |
| (c)-2 | 1 | 3 | — | 0.9 | 4.5 | — |
| (d)-1 | 468.8 | 876 | 489.9 | 463 | 785.3 | 349.9 |
| Total | 1,000 | 1,000 | 1,000 | 1,000 | 1,000 | 1,000 |
| (e)-1 | 5 | 10 | — | 5 | 7 | 7 |

Evaluation Tests (1) Preparation of Samples for Evaluation Tests

Using the compositions shown in Table 1, which were prepared in Examples 1 to 5 and Comparative Example 1 described above, various base materials shown in Table 2 were immersed therein or spray treated therewith to prepare sample Nos. 1 to 15 for evaluation tests.

TABLE 2

| Sample No. | Kind of Base Material | Raw Material of Base Material | Composition | Amount Coated (in terms of stock solution) | Note |
|---|---|---|---|---|---|
| 1 | Stockings (pantyhose) | Nylon | A | 4 g/a pair of stockings | Example |
| 2 | Stockings (pantyhose) | Nylon | B | 3 g/a pair of stockings | Example |
| 3 | Stockings (pantyhose) | Nylon | C | 2 g/a pair of stockings | Example |
| 4 | Stockings (pantyhose) | Nylon | — | Not processed | Control |
| 5 | Stockings (pantyhose) | Nylon-polyurethane | A | 3 g/a pair of stockings | Example |
| 6 | Curtain | Polyester-acrylic | B | 35 g/m$^2$ | Example |
| 7 | Curtain | Polyester-acrylic | C | 20 g/m$^2$ | Example |
| 8 | Curtain | Polyester-acrylic | — | Not processed | Control |
| 9 | Ceiling in Car | Polyester non-woven fabric | A | 20 g/m | Example |
| 10 | Ceiling in Car | Polyester non-woven fabric | D | 15 g/m | Example |
| 11 | Ceiling in Car | Polyester non-woven fabric | F | 15 g/m$^2$ | Comparative Example |
| 12 | Ceiling in Car | Polyester non-woven fabric | — | Not processed | Control |
| 13 | Carpet | Acrylic fiber | D | 40 g/m$^2$ | Example |
| 14 | Carpet | Acrylic fiber | E | 30 g/m$^2$ | Example |
| 15 | Carpet | Acrylic fiber | F | 40 4/m$^2$ | Comparative Example |

In sample No. 1, composition A was diluted 12 times with water, followed by immersion of the base material therein to process it.

In sample No. 2, composition B was diluted 15 times with water, followed by immersion of the base material therein to process it.

In sample No. 3, composition C was diluted 8 times with water, followed by immersion of the base material therein to process it.

In sample No. 5, composition A was diluted 12 times with water, followed by immersion of the base material therein to process it.

In sample No. 6, composition B was diluted 4 times with water, followed by immersion of the base material therein to process it.

In sample No. 7, composition C was diluted 2 times with water, followed by immersion of the base material therein to process it.

In sample No. 9, composition A was diluted 6 times with water, followed by immersion of the base material therein to process it.

In sample No. 10, composition D was diluted 6 times with water, followed by immersion of the base material therein to process it.

In sample No. 11, composition F was diluted 6 times with water, followed by immersion of the base material therein to process it.

In sample No. 13, the base material was spray coated with the stock solution of composition D, followed by pressing with a roll to process it.

In sample No. 14, the base material was spray coated with the stock solution of composition E, followed by pressing with a roll to process it.

In sample No. 15, the base material was spray coated with the stock solution of composition F, followed by pressing with a roll to process it.

Further, sample Nos. 1 to 3 and 5 to 7 were heated and dried at 60° C. for 30 minutes, sample Nos. 9 to 11 at 80° C. for 15 minutes, and sample Nos. 13 to 15 at 80° C. for 30 minutes.

(2) Evaluation Test (1) (Test for Evaluating Antistatic Property)

For evaluating the antistatic property of the compositions of the present invention, a test was performed based on JIS L1094, Method A (half-life measuring method).

Using a static honest meter (manufactured by Shishido Shokai Co.) as a measuring instrument, a voltage of 10 kv was applied for 30 seconds, and then, the time until the charged voltage was reduced by half was measured. The measurement was made in a constant temperature-humidity chamber having a temperature of 20° C. and a relative humidity of 40%. Results

TABLE 3

| Sample No. | Half-Life Time (sec) | Note |
|---|---|---|
| 1 | 2.5 | Example |
| 2 | 3.1 | Example |
| 3 | 3.5 | Example |
| 4 | 76.0 | Control |
| 5 | 2.2 | Example |
| 6 | 3.0 | Example |
| 7 | 3.5 | Example |
| 8 | 110.0 | Control |
| 10 | 3.3 | Example |
| 11 | 15.0 | Comparative Example |
| 12 | 86.0 | Control |
| 14 | 2.5 | Example |
| 15 | 21.0 | Comparative Example |

Then, the above-mentioned respective samples were washed 5 times, and then, the antistatic property thereof was similarly tested. As to the washing of the samples, a washing-dehydration-drying procedure was repeated 5 times by use of a commercial detergents (manufactured by Kao Corp) with an electric washer, followed by evaluation of the antistatic property by the above-mentioned method. Results thereof are shown in Table 4.

TABLE 4

| Sample No. | Half-Life Time (sec) | Note |
|---|---|---|
| 1 | 3.0 | Example |
| 2 | 3.4 | Example |
| 3 | 3.4 | Example |
| 4 | 74.0 | Control |
| 5 | 3.2 | Example |

(3) Evaluation Test (2) (Test for Evaluating Antimicrobial Property)

Antimicrobial Test (1):

For evaluating the antimicrobial property, each of the samples of Table 2 shown above was cut, and placed in a Trichophyton suspension in a specified amount, followed by shaking. The numbers of viable cells in the cell suspension was measured before shaking (before addition of each sample) and after shaking for a specified period of time. Results thereof are shown in Table 5.

TABLE 5

| Sample No. | Before Shaking (cells) | Shaking Time (cells) 1 Hour | 6 Hours | 24 Hours | Note |
|---|---|---|---|---|---|
| 1 | $1.3 \times 10^4$ | ≦10 | ≦10 | ≦10 | Example |
| 2 | $1.3 \times 10^4$ | $1.2 \times 10^2$ | ≦10 | ≦10 | Example |
| 3 | $1.3 \times 10^4$ | $7.2 \times 10^2$ | ≦10 | ≦10 | Example |
| 4 | $1.3 \times 10^4$ | $1.2 \times 10^4$ | $4.2 \times 10^3$ | $1.4 \times 10^3$ | Control |
| 5 | $1.3 \times 10^4$ | $1.1 \times 10^2$ | $4.2 \times 10^3$ | ≦10 | Example |

In Table 5, the indication of "≦10" means that no cells were detected, because of the measurement limit in the cell number measuring method used in this test.

Antimicrobial Test (2):

For evaluating the antimicrobial property, an antimicrobial test was performed using the samples shown in Table 2 in the following manner. That is to say, cell solutions of Pneumobacillus, MRSA and black Aspergillus were each added dropwise to the above-mentioned samples, and polyethylene films were allowed to adhere thereto, followed by storage at 35° C. The viable cell counts of each sample after storage for 3 hours and after storage for 6 hours were measured. In control examples, no compositions of the present invention were applied.

TABLE 6

| Test Cell | Sample No. | Viable Cell Count (per sample) At Start | After 3 Hours | After 6 Hours | Note |
|---|---|---|---|---|---|
| Pneumobacillus | 6 | $2.4 \times 10^5$ | ≦10 | ≦10 | Example |
| Pneumobacillus | 8 | $2.4 \times 10^5$ | $7.2 \times 10^5$ | $1.7 \times 10^6$ | Control |
| Pneumobacillus | 9 | $2.4 \times 10^5$ | ≦10 | ≦10 | Example |
| MRSA | 7 | $4.1 \times 10^5$ | ≦10 | ≦10 | Example |
| MRSA | 12 | $4.1 \times 10^5$ | $4.2 \times 10^5$ | $5.7 \times 10^4$ | Control |
| MRSA | 13 | $4.1 \times 10^5$ | ≦10 | ≦10 | Example |
| MRSA | 15 | $4.1 \times 10^5$ | $2.1 \times 10^4$ | $1.9 \times 10^3$ | Comparative Example |
| Black | 10 | $3.2 \times 10^5$ | $1.8 \times 10^2$ | ≦10 | Example |

TABLE 6-continued

| Test Cell | Sample No. | Viable Cell Count (per sample) At Start | After 3 Hours | After 6 Hours | Note |
|---|---|---|---|---|---|
| Aspergillus | | | | | |
| Black Aspergillus | 11 | $3.2 \times 10^5$ | $6.7 \times 10^3$ | $4.8 \times 10^3$ | Comparative Example |
| Black Aspergillus | 14 | $3.2 \times 10^5$ | ≦10 | ≦10 | Example |

(4) Evaluation Test (3) (Test for Evaluating Air Cleaning Property (Deodorizing Property))

For evaluating the effect of eliminating a malodorous gas, a measuring test was performed using the samples shown in Table 2. That is to say, a column was charged with each sample, and the effect of eliminating the malodorous gas by adsorption was measured by a dynamic test method in which the malodorous gas having a constant concentration was allowed to pass with a pump. A specified amount of the malodorous gas was allowed to pass through the sample, and the concentration of the gas was measured at an inlet and outlet of the column with a gas detector. As the malodorous gas, two kinds of gases, ammonia and formaldehyde were used.

TABLE 7

| Sample No. | Ammonia Concentration (ppm) (initial concentration = 85 ppm) 1 Example | 2 Example | 4 Control | 9 Example | 10 Example | 11 Comparative Example |
|---|---|---|---|---|---|---|
| Elapsed Time (minutes) | | | | | | |
| 60 | 32 | 29 | 68 | 11 | 16 | 45 |
| 180 | 27 | 22 | 66 | 7 | 10 | 31 |
| 360 | 19 | 16 | 59 | N.D. | 7 | 26 |

N.D.: Not detected

TABLE 8

| Sample No. | Formaldehyde Concentration (ppm) (initial concentration = 85 ppm) 6 Example | 7 Example | 8 Control | 13 Example | 14 Example | 15 Comparative Example |
|---|---|---|---|---|---|---|
| Elapsed Time (minutes) | | | | | | |
| 60 | 6 | 4 | 28 | 6 | 5 | 22 |
| 180 | 2 | 2 | 26 | 2 | 1 | 21 |
| 360 | N.D. | 2 | 26 | 2 | N.D. | 22 |

N.D.: Not detected

Property)

For evaluating the humidifying property, the moisture absorption and the moisture release after pretreatment were measured using the samples shown in Table 2.

The pretreatment was conducted in the following manner. Namely, the samples and the control sample were placed in an environmental test chamber, and dried at a temperature of 25° C. at a humidity of 45% for 2 hours. The temperature and humidity under the moisture absorbing conditions were set to 25° C. and 95%, respectively, and those under the moisture releasing conditions were set to 25° C. and 45%, respectively. The amounts (%) of moisture absorbed and released under the above-mentioned conditions for 2 hours were each measured. Results thereof are shown in Table 9.

TABLE 9

| Sample No. | After Pretreatment (25° C./45%) Weight (g) | Amount of Moisture Absorbed (25° C./95%) Weight (h) | Moisture Absorption Rate (%) | Amount of Moisture Released (25° C./45%) Weight (%) | Moisture Release Rate (%) | Note |
|---|---|---|---|---|---|---|
| 1 | 23 | 42 | 83 | 25 | 89 | Example |
| 2 | 23 | 42 | 83 | 27 | 79 | Example |
| 3 | 23 | 42 | 83 | 28 | 74 | Example |
| 4 | 23 | 38 | 65 | 31 | 47 | Control |
| 5 | 29 | 50 | 72 | 35 | 71 | Example |

What is claimed is:

1. A composition for use as an antistatic finish comprising (a) 100 parts by weight of colloidal or ultrafine granular alumina on a solid basis, (b) 3 parts to 50 parts by weight of a binder on a solid basis, (c) 0.02 part to 2 parts by weight of at least one member selected from the group consisting of silver salts, copper salts and colloidal silver on a metallic atom basis, and (d) 848 parts to 986.08 parts by weight of water, including water contained in the components of (a) to (c).

2. The composition according to claim 1, wherein the average particle size or the average thickness of said colloidal or ultrafine granular alumina is 5 mμ to 50 mμ.

3. The composition according to claim 1, wherein said binder is a synthetic resin emulsion and/or a water-soluble synthetic resin.

4. A process for imparting an antistatic finish to base materials which comprises applying to the materials the composition of claim 1 followed by drying.

5. The process of claim 4 wherein the base materials are clothes.

6. The process of claim 4 wherein the base materials are stockings.

7. Stockings to which has been applied the composition for antistatic finish according to claim 1.

* * * * *